United States Patent [19]

Capjon et al.

[11] Patent Number: 5,056,777

[45] Date of Patent: Oct. 15, 1991

[54] FORCE TRANSMISSION MECHANISM FOR EXERCISE MACHINES

[75] Inventors: Jan Capjon, Fagerstrand; Atle Nygaardsvik, Fjellstrand, both of Norway

[73] Assignee: Potential Training Products Co. Inc., Oakville, Canada

[21] Appl. No.: 480,538

[22] Filed: Feb. 15, 1990

[51] Int. Cl.[5] ..... A63B 21/06

[52] U.S. Cl. ..... 272/117; 272/134

[58] Field of Search ..... 272/117, 118, 123, 134

[56] References Cited

U.S. PATENT DOCUMENTS

| | | | |
|---|---|---|---|
| 4,195,834 | 4/1980 | Lambert, Jr. | 272/118 |
| 4,199,139 | 4/1980 | Mahnke et al. | 272/118 |
| 4,333,644 | 6/1982 | Lambert, Jr. et al. | 272/118 |
| 4,402,504 | 9/1983 | Christian | 272/118 |
| 4,549,733 | 10/1985 | Salyer | 272/118 |
| 4,616,825 | 10/1986 | Anderson | 272/117 X |
| 4,842,270 | 6/1989 | Lange | 272/117 |

*Primary Examiner*—Robert Bahr

*Attorney, Agent, or Firm*—Carson, Armstrong

[57] ABSTRACT

An exercise machine is disclosed, in which there is a frame, an exercise portion moveable with respect to the frame, weights raisable with respect to the frame, and a cable connecting the weights to the exercise portion. The force transmission mechanism between the weights and the exercise portion involves first and second pivot points mounted to the frame and spaced apart from each other in a plane substantially parallel to and spaced from the plane of movement of the exercise portion, and a third pivot point mounted to the exercise portion and moveable therewith. The cable is connected at one end to the frame, passing around one of the first and second pivot points, then to and passing around the third pivot point, then to and passing around the other of the first and second pivot points, thus defining a triangle with the third pivot point constituting a moveable apex, and then connecting at its other end to the weights. This arrangement produces a resistance which varies with the displacement of the exercise portion of the machine.

1 Claim, 2 Drawing Sheets

FORCE TRANSMISSION MECHANISM FOR EXERCISE MACHINES

BACKGROUND OF THE INVENTION

1. Field of the Invention

This invention relates to exercise equipment, and in particular to a force transmission mechanism for exercise machines to provide a resistance which varies with distance.

2. Description of the Prior Art

It is known to use various combinations of weights and pulleys in exercise machines, to provide a resistance for the person to work against. It is most common in such machines for the force transmission mechanism to have a constant mechanical advantage, whether 1:1 or some other ratio.

For example, one common machine is a so-called "hack lift", which consists of a generally vertical board with two parallel horizontal protrusions extending from each edge. The board is on a track and connected to a pulley system to which a weight is attached. The person faces away from the board and crouches so that his or her head is between the two protrusions and the shoulders contact the underside of each protrusion.

In a conventional hack lift, there is a constant mechanical advantage. That is, the resistance is constant throughout the lift. Thus a sudden exertion is required at the beginning of the lift, which is not desirable for several reasons. First of all, there is the potential for injury due to the large initial force required. Secondly, the constant mechanical advantage does not take into account the fact that the person is able to exert a much larger force as the legs approach being straight, as opposed to when the person is in a crouched position.

Thus in a hack lift, and in many other exercise machines, there is a need for a force transmission mechanism which includes a variable mechanical advantage, such that the resistance varies with position. In a hack lift, for example, it would be preferable for the resistance to be relatively low when the person is crouched, and to increase as the person's legs straighten.

SUMMARY OF THE INVENTION

It is an object of the invention to provide a force transmission mechanism in an exercise machine, to produce a varying mechanical advantage and thus a varying resistance.

Thus the invention provides an improvement for an exercise machine having a frame, an exercise portion moveable with respect to the frame, weights raisable with respect to the frame, and force transmission means connecting the weights to the exercise portion to resist movement thereof. The improvement involves first and second pivot points mounted to the frame and spaced apart from each other in a plane substantially parallel to and spaced from the plane of movement of the exercise portion, and a third pivot point mounted to the exercise portion and moveable therewith. Flexible connection means, such as a cable, is connected at one end to the frame, passing around one of the first and second pivot points, thence to and passing around the third pivot point, thence to and passing around the other of the first and second pivot points, thus defining a triangle with the third pivot point constituting a moveable apex, and thence connecting at its other end to the weights. As explained below, this arrangement produces a resistance which varies with the displacement of the exercise portion of the machine.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

It will be appreciated that the force transmission mechanism can be applied to a wide variety of exercise machines. For convenience, the preferred embodiment will be described with reference to a hack lift, illustrated in FIGS. 1 and 2.

Figure 1:
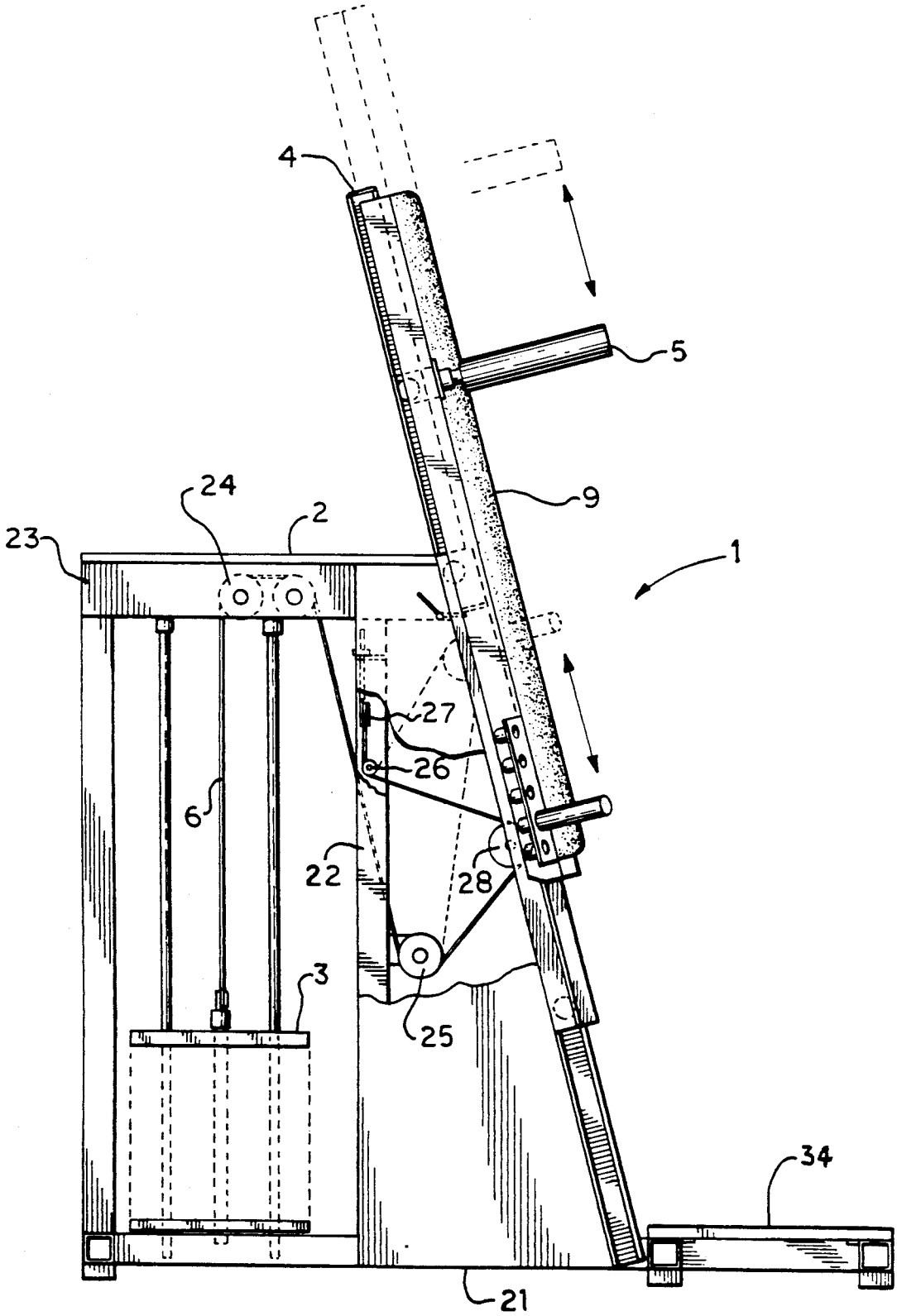
FIG. 1 is a side view of a hack lift incorporating the force transmission mechanism.
Figure 2:
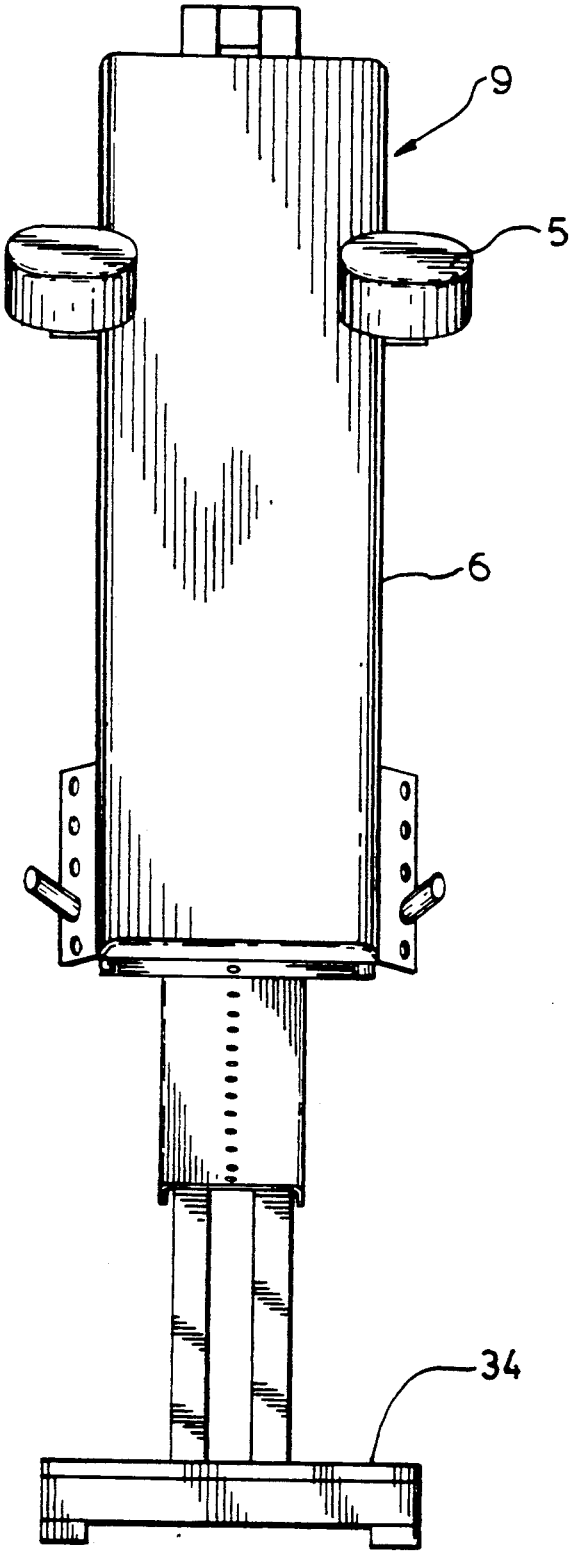
FIG. 2 is a front view of the hack lift.

Referring to FIG. 1, the hack lift 1 includes a supporting frame 2, weights 3, a transmission cable 6, a generally vertical track 4 and back board 9. As is best shown in FIG. 2, attached to each vertical edge of the back board 9 and close to the top are shoulder bars 5. Handles 7 are affixed to each vertical edge of the back board 9 close to the bottom. The back board, shoulder bars and handles slide up and down the track 4.

The person stands on the platform 34 facing forwardly, i.e. away from the hack lift. He or she crouches so that the shoulder bars 5 rest on the shoulders, the back rests against the back board and the hands grip the handles. As the person stands up, the back board, shoulder bars and handles slide up the track 4.

The supporting frame 2 includes a base 21. At the front of the base 21 are four legs 22 which support a top 23. The front edge of the top extends forward of the front legs. The vertical track rests on the base and leans against the front edge of the top. The part of the base forward of the bottom of the tracks is covered by a pad so as to form a platform 34.

The weights 3 are piled on the base 21 within the enclosure defined by the legs 22. A spike 8 passes vertically through the weights. One end of the transmission cable 6 is affixed to the top of the spike. The number of weights that are lifted by the transmission cable can be set by inserting a pin horizontally through a weight and the spike. The weight with the pin and all the weights above the pin are thereby lifted.

The cable 6 is routed from the spike 8 upwardly to and forwardly over two upper pulleys 24 affixed to the underside of the top 23, thence downwardly to and forwardly under a lower pulley 25, thence to and around a moveable pulley 28 mounted to the back board, thence rearwardly to a pivot pin 26 and attachment point 27 between the legs 22.

The pivot pin 26, lower pulley 25, and moveable pulley 28 define a triangle. The base of the triangle defined by a line between the pivot pin and the lower pulley, is substantially parallel to the tracks and back board. The apex of the triangle, defined by the moveable pulley 28, moves with the movement of the back board.

The force transmitted to the back board by the weights is the resultant of the force vectors along the sections of cable leading from the moveable pulley 28.

As can be readily seen from FIG. 1, in the main position shown, the resultant force F is essentially perpendicular to the track. The weights therefore provide no resistance to upward movement of the back board.

However, as the back board and moveable pulley move towards the position shown in ghosted lines in FIG. 1, two things happen. Firstly, the angle of the resultant force F' changes so that it aligns more and more against upward movement of the back board. Secondly, the magnitude of the resultant force increases as well, since the angle at the apex of the triangle is reduced. The combined effect is a force transmission which produces increasing resistance as the back board is raised.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, as previously mentioned, it should be apparent that the invention could be applied to a wide variety of exercise machines, essentially whenever it is desired to have the force vary with displacement. It should also be apparent that the force vs. displacement characteristics could be readily varied to suit the particular exercise machine and desired characteristics, merely by varying the proportions, angles and relative positions of the three corners of the "triangle".

What is claimed as the invention is:

1. In an exercise machine comprising a frame, an exercise portion moveable with respect to said frame, weights raisable with respect to said frame, and force transmission means connecting said weights to said exercise portion to resist movement of said exercise portion, the improvement in which said force transmission means comprises:

first and second pivot points mounted to said frame and spaced substantially apart from each other with pivot axes in a plane substantially parallel to and spaced from the plane of movement of said exercise portion, said exercise portion being confined to movement within a plane;

a third pivot point mounted to said exercise portion and moveable therewith; and flexible connection means connected at one end to said frame, passing around one of said first and second pivot points, thence to and passing around said third pivot point, thence to and passing around the other of said first and second pivot points, thus defining a triangle with said third pivot point constituting a moveable apex, and thence connecting at its other end to said weights, where said exercise portion comprises a member slidable on at least one track mounted to said frame generally parallel to the plane of said pivot axes of said first and second pivot points.

* * * * *